US011834799B2

(12) United States Patent
Phillips et al.

(10) Patent No.: US 11,834,799 B2
(45) Date of Patent: Dec. 5, 2023

(54) SNOW SHOVEL WITH BOX SUPPORT STRUCTURE

(71) Applicant: SUNCAST TECHNOLOGIES, LLC, Palm Beach Gardens, FL (US)

(72) Inventors: William J. Phillips, Batavia, IL (US); Torrence Anderson, Overland Park, KS (US); Stephen Whitehead, Elgin, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 641 days.

(21) Appl. No.: 16/990,435

(22) Filed: Aug. 11, 2020

(65) Prior Publication Data

US 2022/0049443 A1 Feb. 17, 2022

(51) Int. Cl.
*E01H 5/02* (2006.01)

(52) U.S. Cl.
CPC ..... *E01H 5/02* (2013.01)

(58) Field of Classification Search
CPC ..... E01H 5/02
USPC ..... 37/265
See application file for complete search history.

(56) References Cited

U.S. PATENT DOCUMENTS 722,825 A 3/1903 Ester
964,453 A * 7/1910 Robarge ..... E01H 5/02 30/169
1,319,306 A 10/1919 Rogers
3,334,939 A 8/1967 Bonic
5,419,600 A 5/1995 Tisbo et al.
D360,564 S 7/1995 Tisbo et al.
D363,653 S 10/1995 Tisbo et al.
5,695,229 A 12/1997 Chang
D390,431 S 2/1998 Whitehead et al.
D393,990 S 5/1998 Whitehead et al.
D397,005 S 8/1998 Whitehead et al.
5,826,929 A 10/1998 Tisbo et al.
D405,330 S 2/1999 Whitehead et al.
D409,886 S 5/1999 Whitehead et al.
5,918,920 A * 7/1999 Tamburro, Sr. ..... A01B 1/022 294/51
D415,663 S 10/1999 Whitehead et al.
6,497,439 B1 * 12/2002 Guo ..... E01H 5/02 294/56
D477,194 S 7/2003 Markley
D477,755 S 7/2003 Markley
7,118,145 B1 10/2006 Rosine et al.
7,156,435 B1 * 1/2007 Mourelatos ..... E01H 5/02 294/54.5
D553,920 S 10/2007 Rosine et al.
D563,182 S 3/2008 Kopp
D798,680 S * 10/2017 Blouin ..... D8/10
(Continued)

*Primary Examiner* — Gary S Hartmann
(74) *Attorney, Agent, or Firm* — McHale & Slavin, P.A.

(57) ABSTRACT

A support structure for securing a handle member to the blade portion of a snow shovel or snow pusher. The support structure includes an enclosed and contoured box portion having separated walls integrally formed to one another supporting the connection between the handle member and the blade portions of the shovel assembly. The box support structure provides lightweight multidirectional support while preventing build-up of snow and ice from the combined assembly. The support structure allows the blade member to be formed flat and smooth for low resistance operation for snow and ice removal.

18 Claims, 14 Drawing Sheets

(56) References Cited

U.S. PATENT DOCUMENTS

D938,241 S * 12/2021 Phillips ..... D8/10
D963,440 S * 9/2022 Phillips ..... D8/10

* cited by examiner

SNOW SHOVEL WITH BOX SUPPORT STRUCTURE

FIELD OF INVENTION

The present invention generally relates to shovels and, more particularly, to a support structure having a box shaped structure for a snow shovel or snow pusher assembly.

BACKGROUND INFORMATION

Snow shovels and snow pushers generally include an elongated handle for grasping by the user. The handle extends down to a plate member that attaches to the back side of a blade member and the distal end of the handle to secure the handle to the back side of the blade. Because the plate member is generally weak in structure, the blade member typically includes several curves, rolled beads and turned up edges to provide support to the blade to prevent it from buckling under a load. The alternative to the curves, rolled beads and turned up edges is to make the blade extremely thick and heavy to withstand the loads it is subjected to during use.

One drawback to the standard designs is the cost associated with forming the curves, rolled beads, etc. when the blade is formed from a metal such as aluminum. Multiple machine operations are often required to form all of the bends and curves necessary to provide the structure required for use. With respect to plastic blades, the cost is also increased due to the additional work required to form the mold that includes the curves, rolled beads, etc.

An additional drawback relates to the open sided nature of the plates used to attach the handle to the back of the blade. The open sided nature of the plates, which may include gussets, subjects them to corrosion when they are formed from metal because of the salts that are often used in conjunction with the snow shovel. The open side surfaces allow the salt to infiltrate the interphase between the plate and the blade where the salt remains, even after the water evaporates, causing oxidation and deterioration. When gussets or the like are used to provide support, snow and ice often build up during use, adding significant weight to the shovel assembly.

Finally, there are ergonomic needs that a snow shovel blade mounting system must satisfy in order to achieve acceptance by the end user. The system must be easily and quickly assembled using minimal hardware and requiring a minimal number of tools. Further, the system should not require excessive strength to assemble or include heavy component parts. Moreover, the system must assemble together in such a way so as not to detract from the aesthetic appearance of the assembled snow shovel or snow pusher device.

Thus, the present invention provides an attachment structure that connects the handle to the blade which overcomes the disadvantages of prior art. The blade attachment structure of the present invention not only provides for relative ease in the assembly, it also permits a lightweight overall structure that can withstand large loads for longer periods without ice and snow build-up during use.

SUMMARY OF THE INVENTION

Briefly, the invention involves a support structure for securing a handle member to the blade portion of a snow shovel or snow pusher. The support structure includes an enclosed and contoured box portion having separated walls integrally formed to one another supporting the connection between the handle member and the blade portions of the shovel assembly. The box support structure provides lightweight multidirectional support while preventing build-up of snow and ice from the combined assembly. The support structure allows the blade member to be formed flat and smooth for low resistance operation for snow and ice removal.

Accordingly, it is an objective of the present invention to provide a support structure for a shovel to attach a handle to a blade.

It is a further objective of the present invention to provide a support structure that includes a box portion having separated walls for structure.

It is yet a further objective of the present invention to provide a support structure having a plurality of blade support ribs for providing support to a blade member.

It is another objective of the present invention to provide a support structure having a plurality of boxes within a single box structure for dividing and supporting loads between the handle and the blade.

It is yet another objective of the present invention to provide a support structure for attaching a handle to a shovel blade that provides suitable structure to allow the use of substantially flat blades as they extend transversely with respect to the longitudinal axis of the shovel.

Other objectives and advantages of this invention will become apparent from the following description taken in conjunction with the accompanying drawings wherein are set forth, by way of illustration and example, certain embodiments of this invention. The drawings constitute a part of this specification, include exemplary embodiments of the present invention, and illustrate various objects and features thereof.

DETAILED DESCRIPTION OF THE PREFERRED EMBODIMENTS

Figure 1:
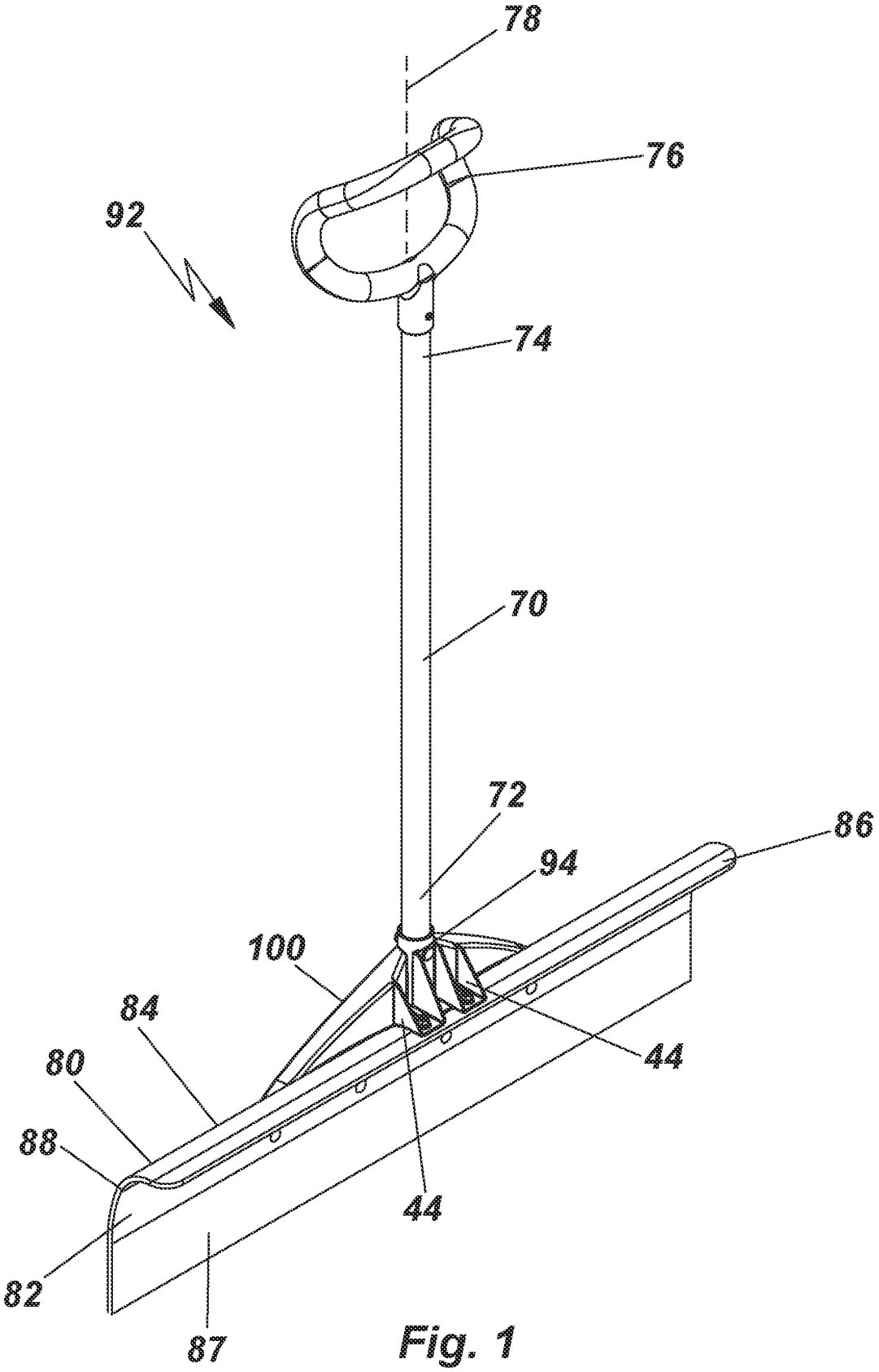
FIG. 1 is a top front left perspective view of one embodiment of a snow pusher assembly utilizing the box support structure.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
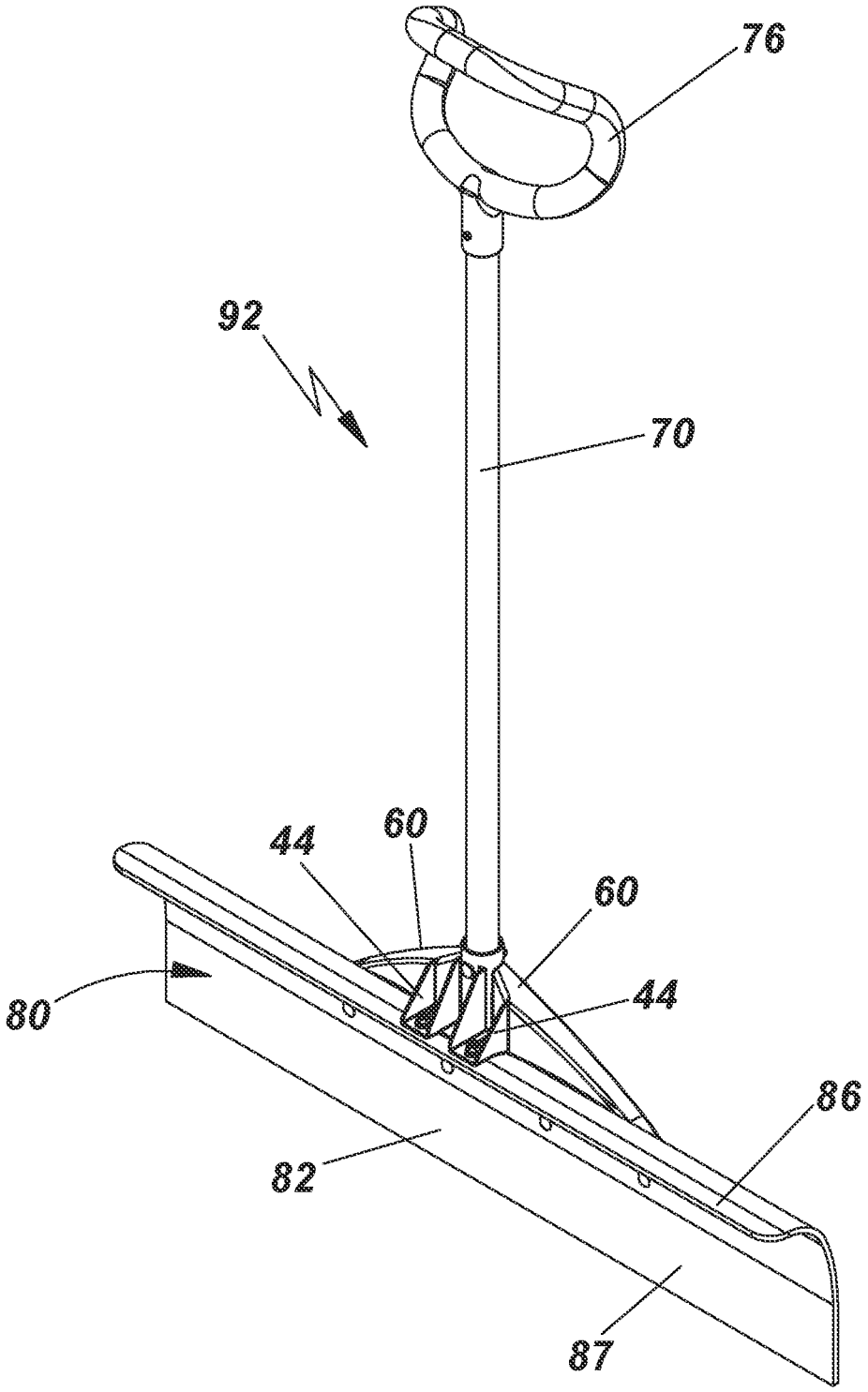
FIG. 2 is a top front right perspective view of one embodiment of a snow pusher assembly utilizing the box support structure.
Figure 3:
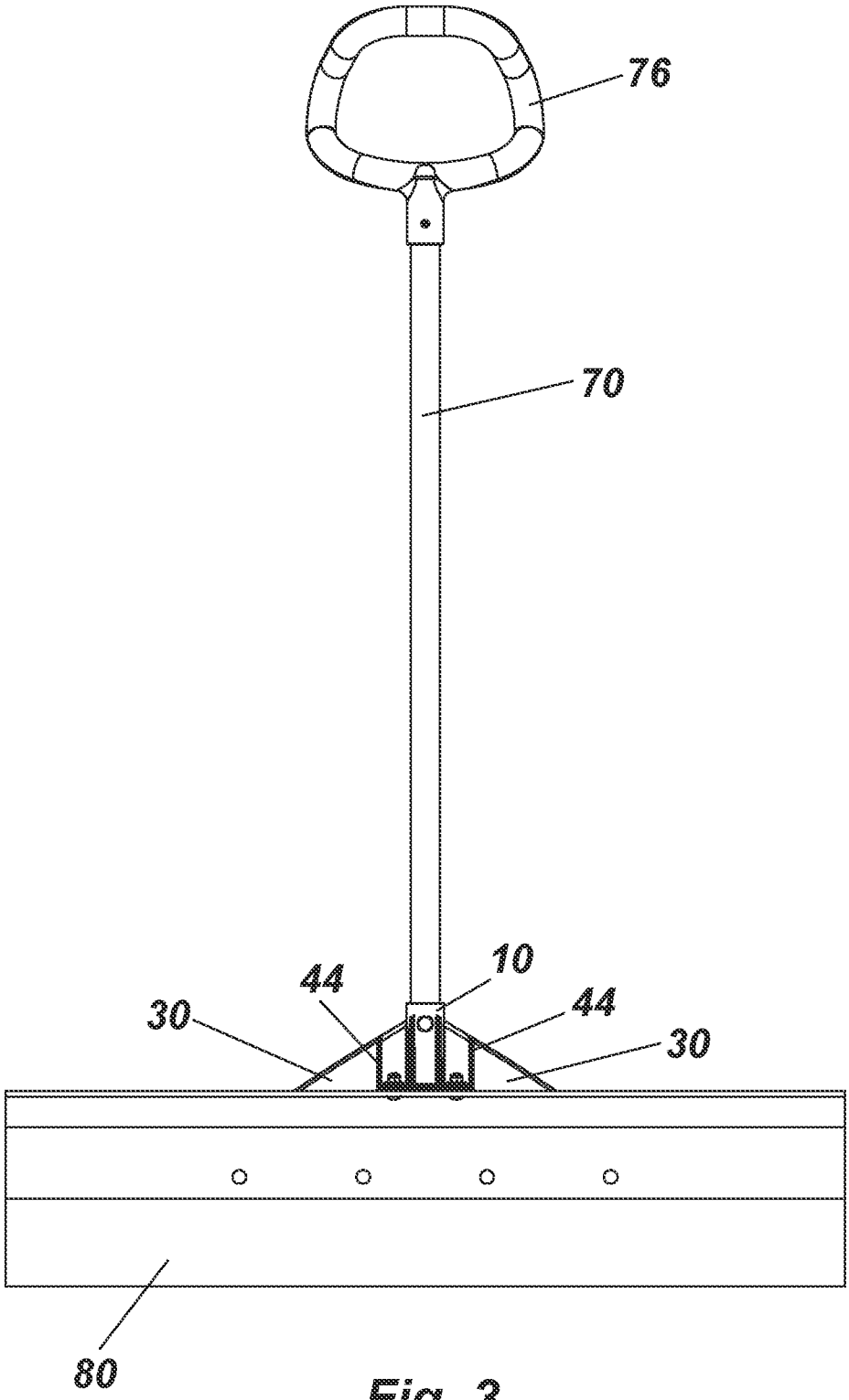
FIG. 3 is a front view of the embodiment shown in FIG. 1.
Figure 4:
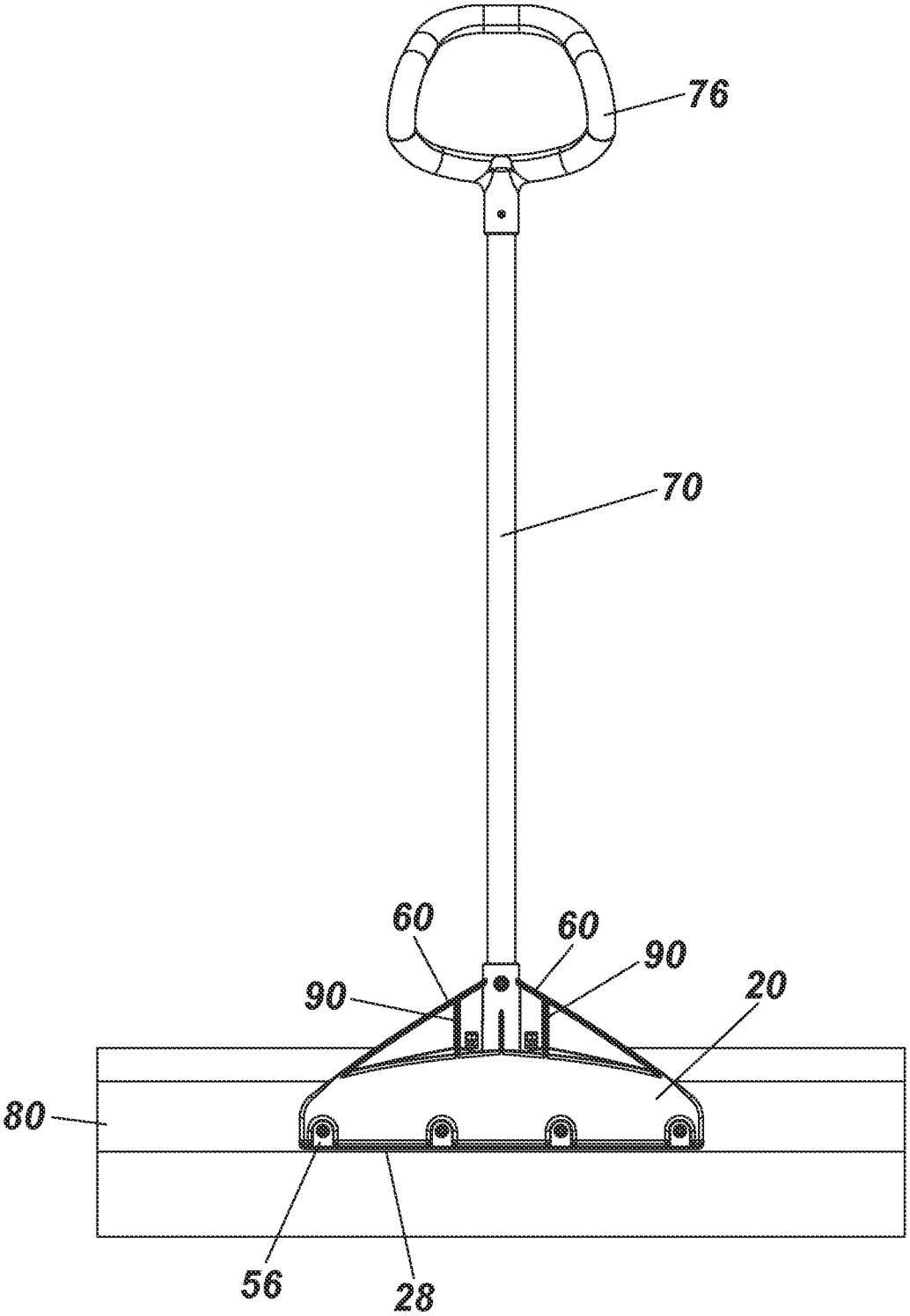
FIG. 4 is a rear view of the embodiment shown in FIG. 1.
Figure 5:
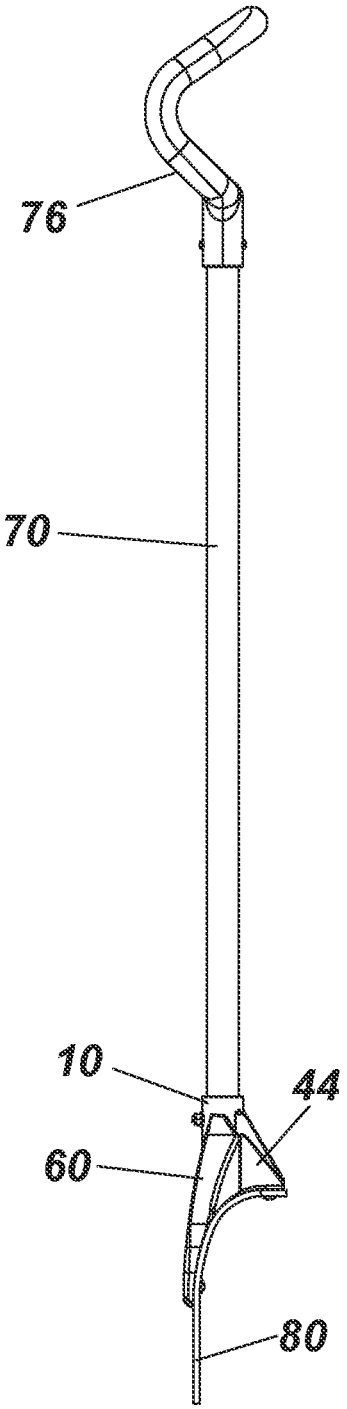
FIG. 5 is a left side view of the embodiment shown in FIG. 1.
Figure 6:
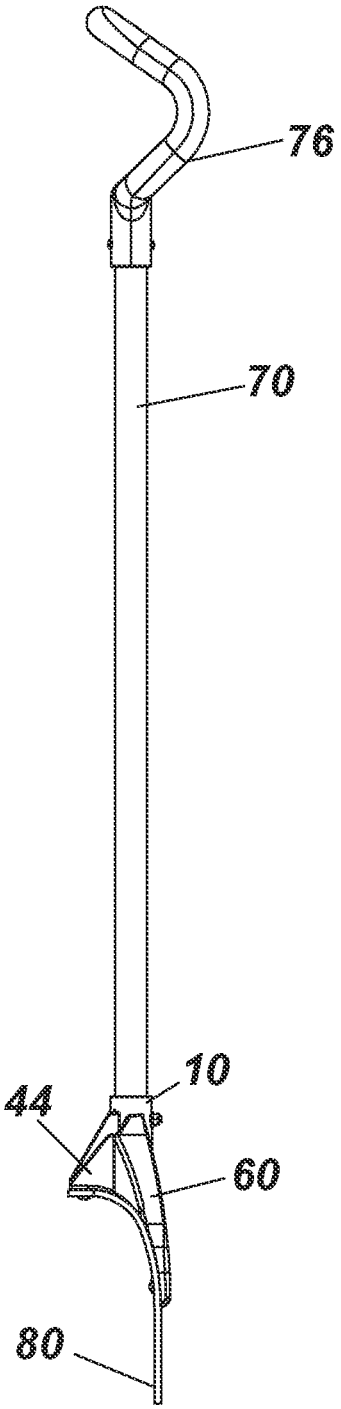
FIG. 6 is a right side view of the embodiment shown in FIG. 1.
Figure 7:
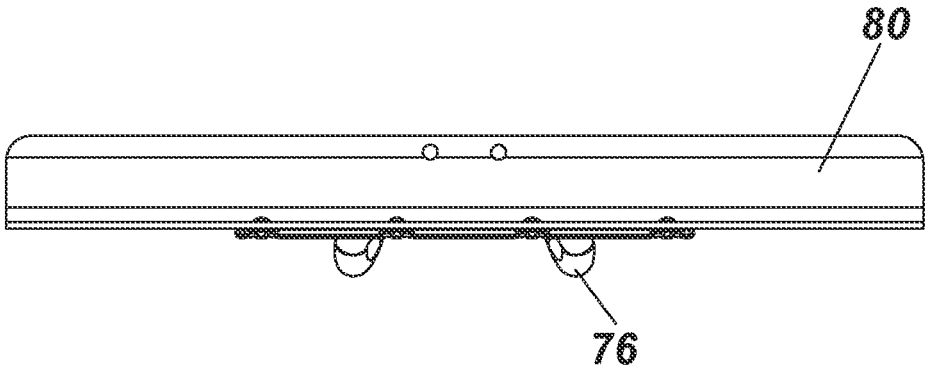
FIG. 7 is a bottom view of the embodiment shown in FIG. 1.
Figure 8:
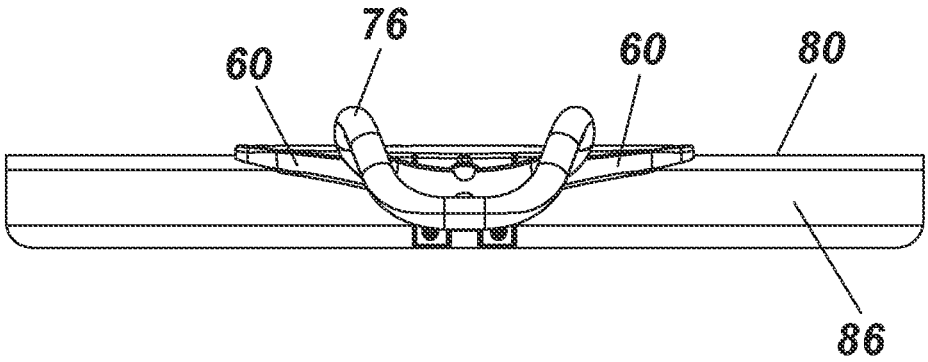
FIG. 8 is a top view of the embodiment shown in FIG. 1.
Figure 9:
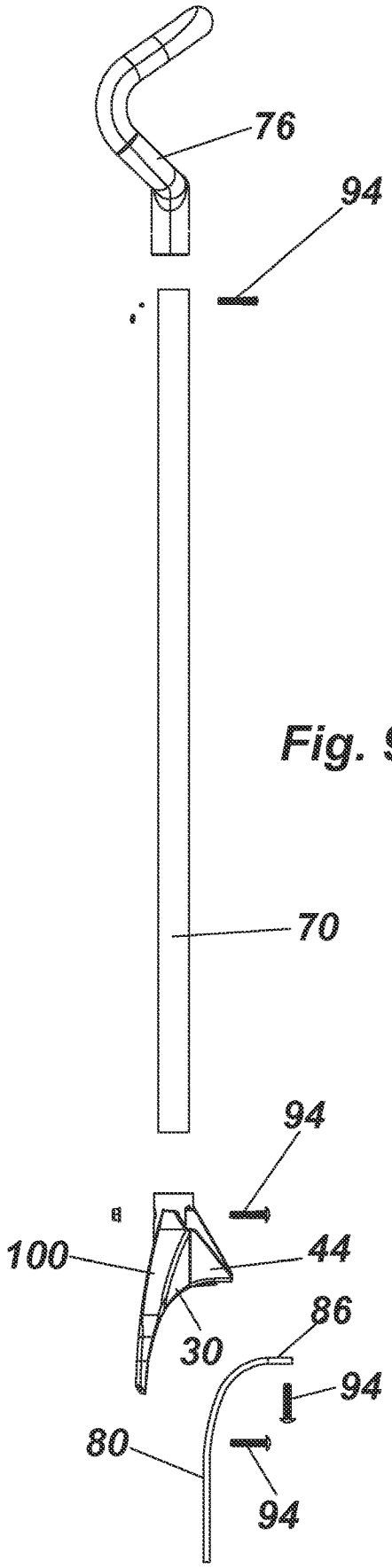
FIG. 9 is an exploded view of the embodiment shown in FIG. 1.
Figure 10:
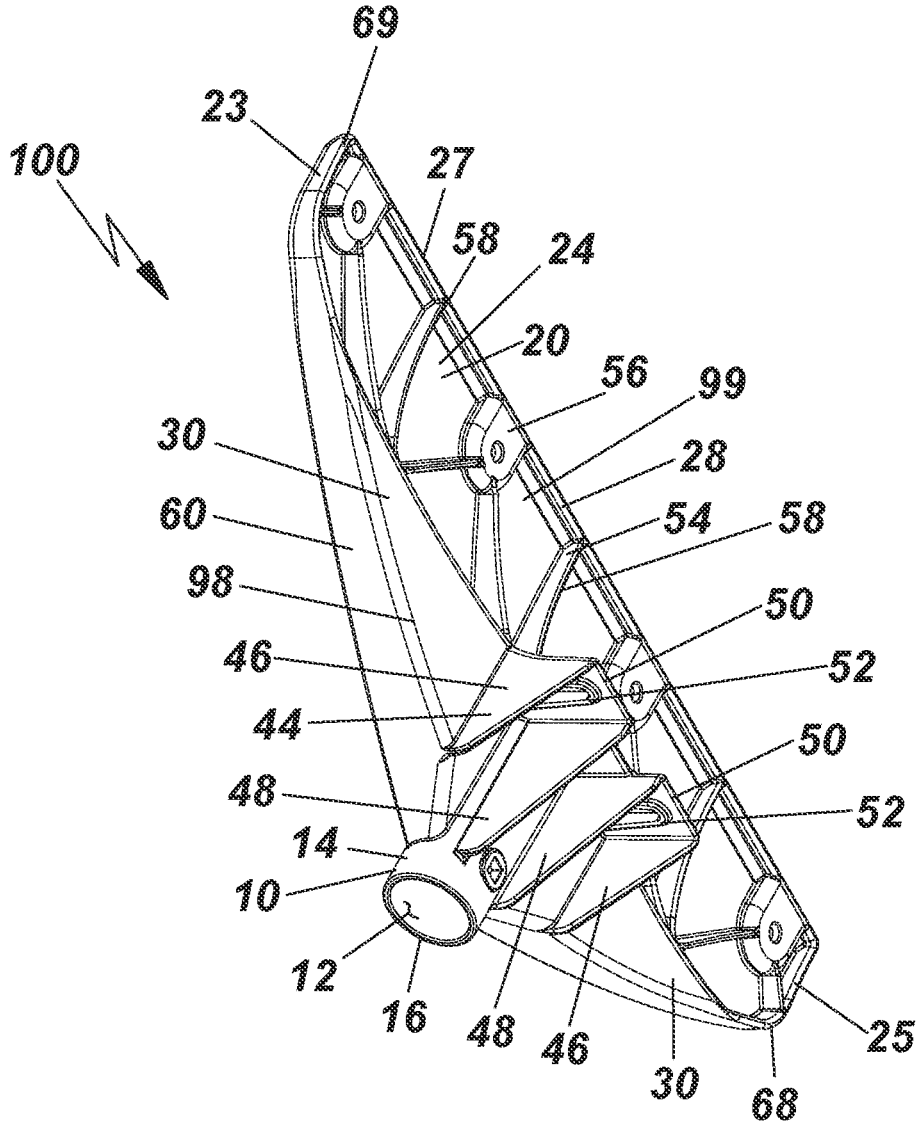
FIG. 10 is a top front right perspective view of the box support structure of the present invention.
Figure 11:
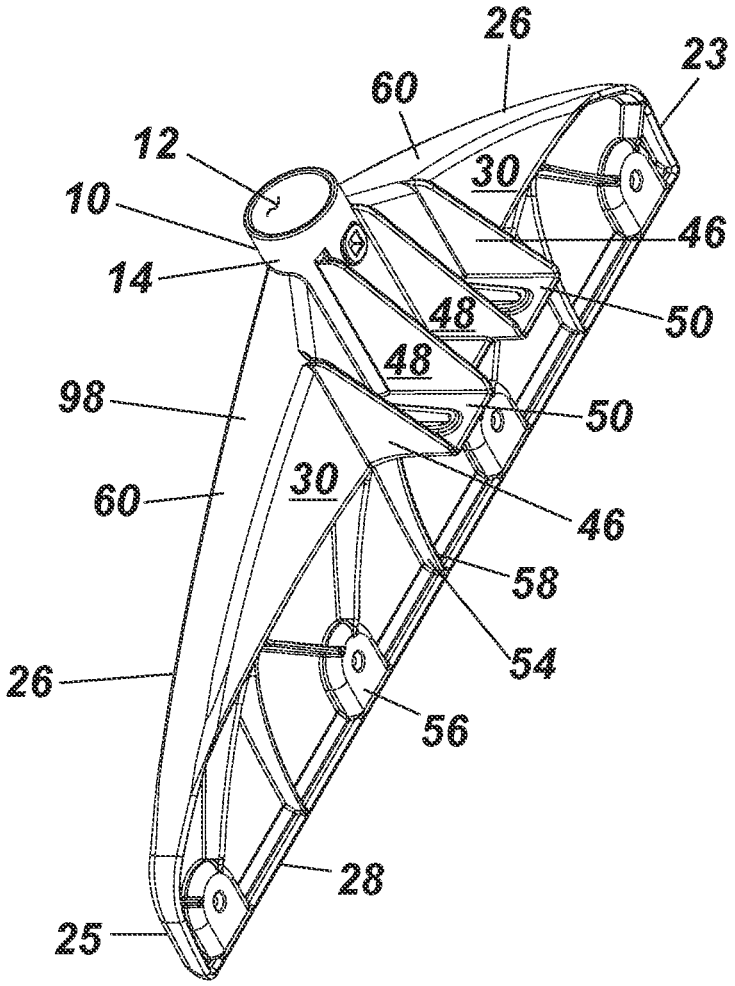
FIG. 11 is a top front left perspective view of the box support structure of the present invention.
Figure 13:
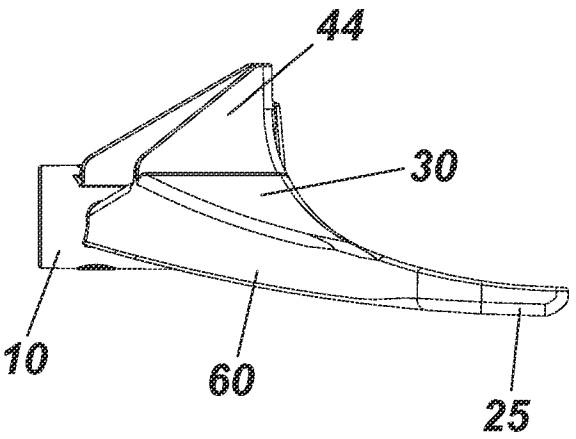
FIG. 13 is a left side view of the box support structure.
Figure 12:
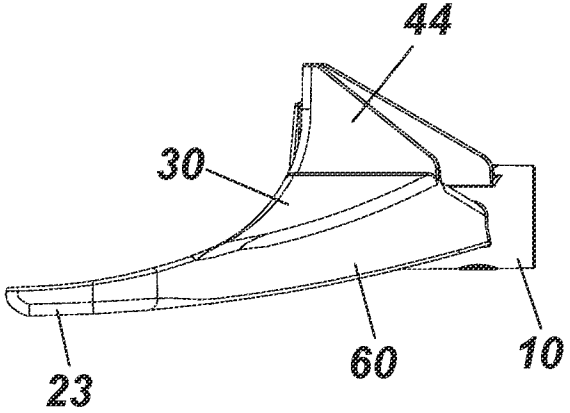
FIG. 12 is a right side view of the box support structure.
Figure 14:
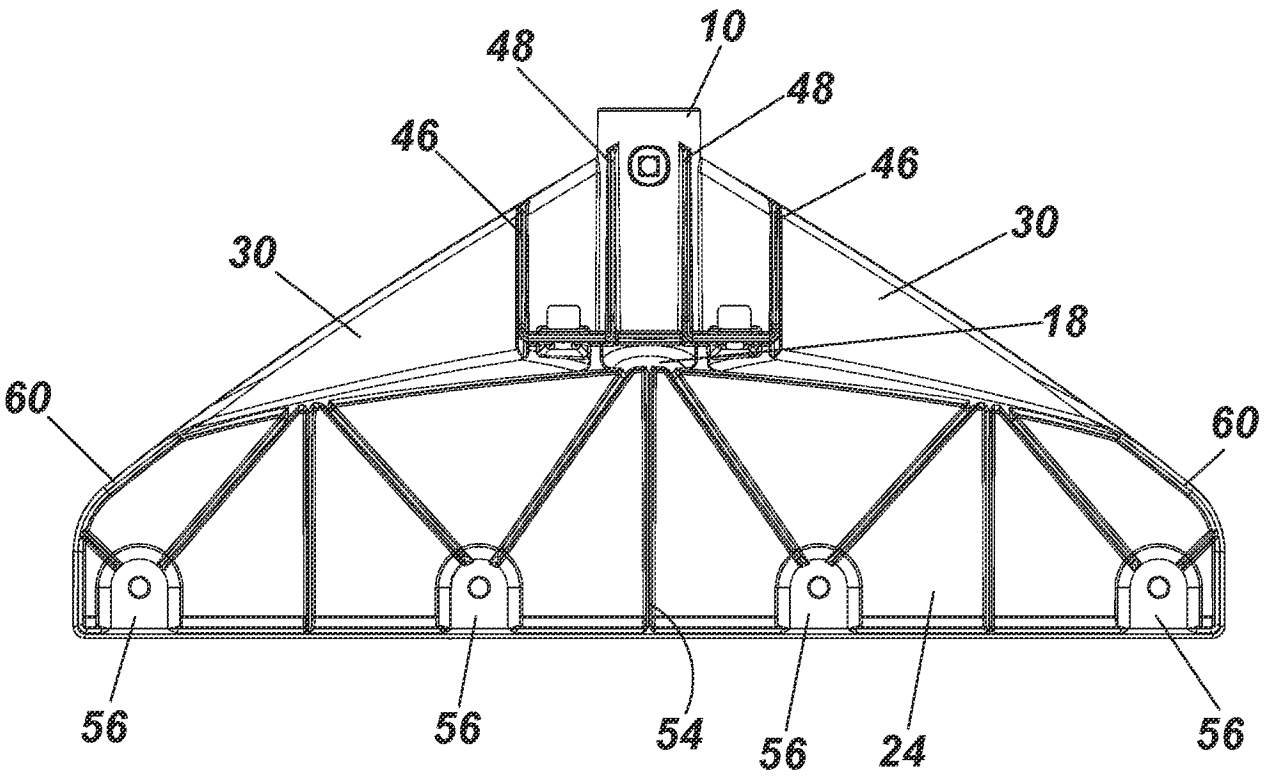
FIG. 14 is a front view of the box support structure.
Figure 15:
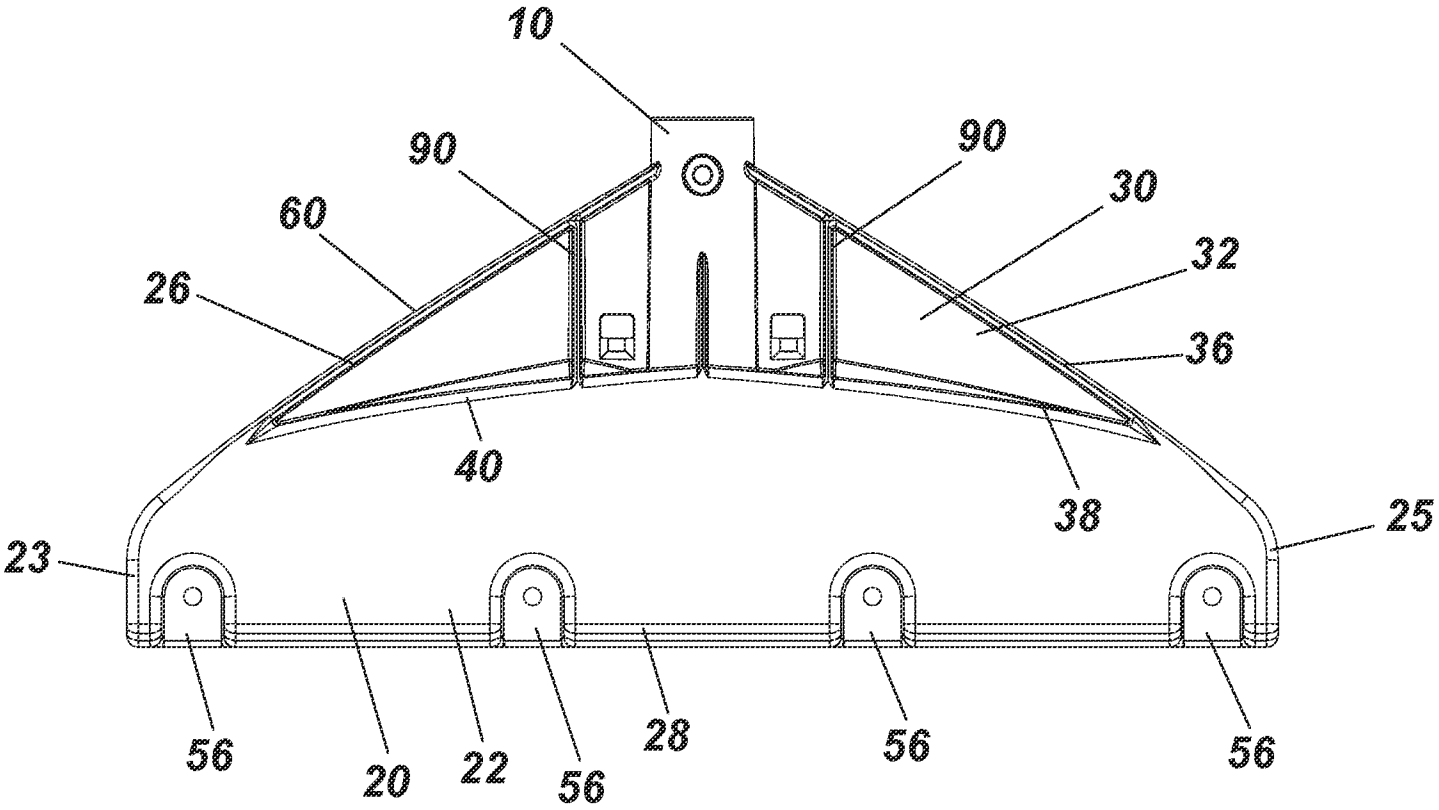
FIG. 15 is a rear view of the box support structure.
Figure 16:
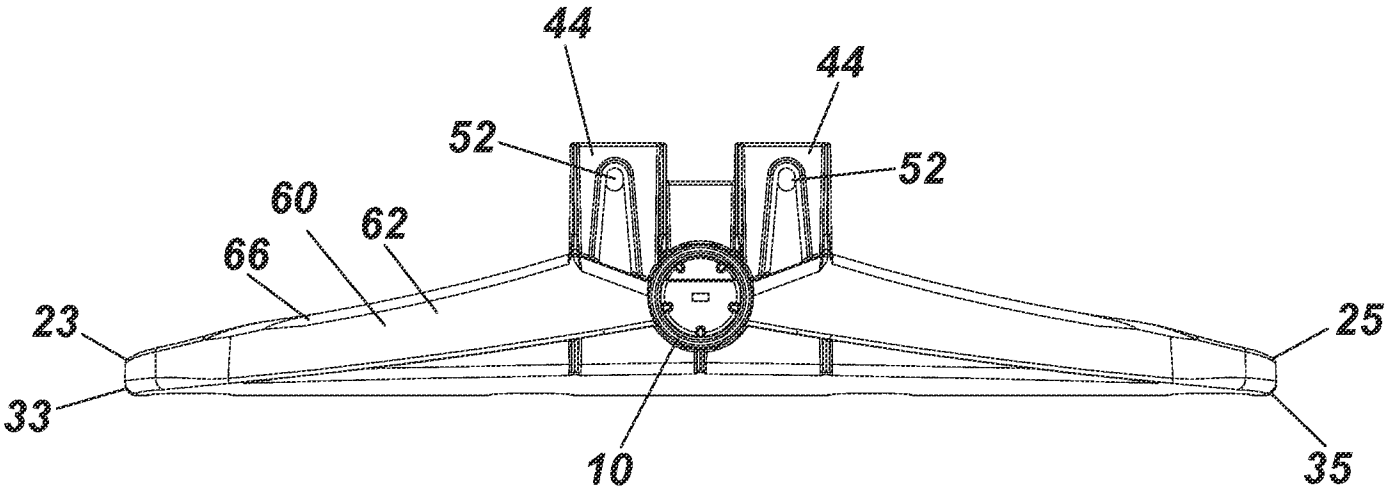
FIG. 16 is a top view of the box support structure.
Figure 17:
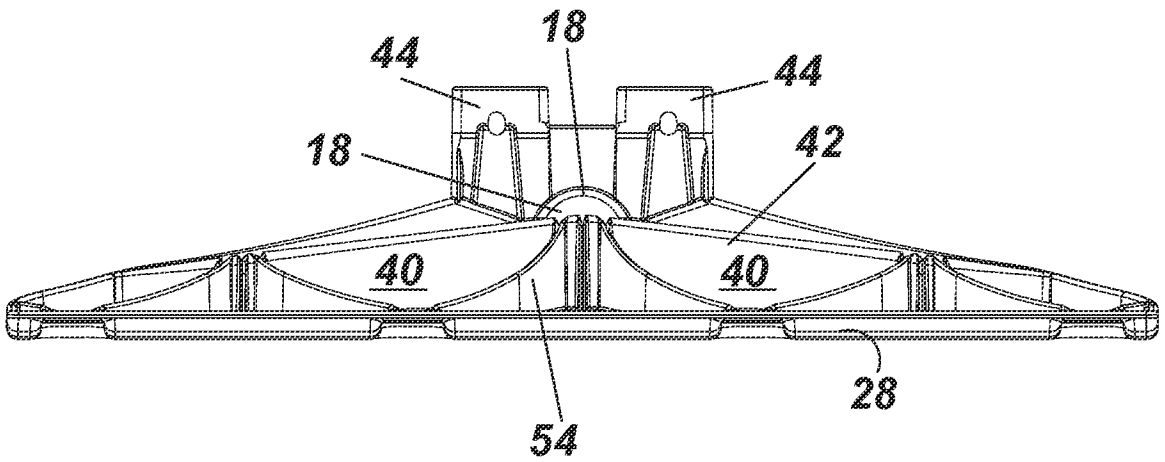
FIG. 17 is a bottom view of the box support structure.

Referring generally to FIGS. 1-17, a support structure 100 for connecting the blade member 80 to the handle 70 of a shovel 92 is illustrated. The support structure 100 includes a handle tube member 10. The handle tube member 10 includes an inner tubular surface 12, an outer tubular surface 14, a top end surface 16 and a bottom end surface 18. The inner tubular surface 12 has a substantially conjugate shape with respect to a first end 72 of a shovel handle 70 for receiving the first end of the shovel handle therein, as illustrated in FIGS. 1-6. Fasteners 94 and/or the respective conjugate shapes of the handle and the handle tube member prevent rotation between the two components during shovel 92 operation.

A rear wall 20, including an outer surface 22, an inner surface 24, a rear wall perimeter surface 26 and a perimeter bottom surface 27 is preferably integrally formed to the outer tubular surface 14 of the handle tube member 10 along a rear portion thereof with the rear wall 20 extending outward with respect to the handle tube member 10 to provide support to the blade member 80. A front wall 30 is spaced apart from and extending generally parallel with respect to the rear wall 20 so that a space remains between the front wall 30 and the rear wall 20 at construction and during use. The front wall 30 is preferably integrally formed to the handle tube member 10 along a front portion thereof and extending outwardly with respect thereto. A top wall 60 is integrally formed to a perimeter surface 36 of the front wall 30 and a perimeter surface 26 of the rear wall 20, connecting the front wall 30 and the rear wall 20 along a top perimeter surface 26, 36 and the left side perimeter surface 25 and the right side perimeter surface 23 of the rear wall. The top wall 60 is also preferably integrally formed to the handle tube member 10, extending between the front wall 30 and the rear wall 20 to form the top portion of the box structure 98. The front wall 30 terminates short of the length of the rear wall 20. An intermediate wall 40 is integrally formed to and extending from a bottom perimeter surface 38 of the front wall 30 to the inner surface 24 of the rear wall 20 where it is also integrally formed, enclosing a bottom portion of the box structure formed by the rear wall 20, the front wall 30, the top wall 60 and the intermediate wall 40. In some embodiments, the box structure 98 may include at least one divider rib 90 integrally formed to and extending between the rear wall 20 and the front wall 30, providing structural support to the box structure by distributing the load over more area of the walls that combine to form the box structure. The divider rib 90 may also be integrally formed and extending between the top wall 60 and the intermediate wall 40.

Still referring generally to FIGS. 1-17, in a preferred embodiment the rear wall 20 and the top wall 60 extend beyond the length of the front wall 30 to support a shovel blade member 80. A perimeter bottom wall 28 is integrally formed to the top wall 60 and the rear wall 20 to provide a space between a rear surface 84 of the blade member 80 and the inner surface 24 of the rear wall 20. The shovel blade member 80 is positioned and secured to be in contact with a perimeter bottom surface 27 of the perimeter bottom wall 28 and the left side perimeter top wall 68 and said right side perimeter top wall 69 to maintain the spacing between the rear surface 84 of the blade member 80 and the inner surface 24 of the rear wall 20. In this manner, a hollow area is maintained behind the blade member 80 with the blade member forming the front wall to create a second box structure 99 positioned adjacent and below the first box structure 98.

Still referring generally to FIGS. 1-17, in at least one embodiment, the outer surface 14 of the handle tube member 10 is integrally formed to the intermediate wall 40. Alternatively, or in addition to, attaching the outer surface 14 of the handle tube member 10 to the intermediate wall 40, the bottom end surface 18 of the handle tube member 10 may be integrally formed to the intermediate wall 40. This construction ties the handle tube member 10 integrally into the box structures 98, 99 to create a rigid assembly.

In at least some embodiments, at least one blade support channel 44 is integrally formed to and extending outwardly from the outer surface 32 of the front wall 30. In general, the blade support channel 44 is adapted to support an upturned portion of the blade member. In a most preferred embodiment, a pair of blade support channels is provided, each including an outer blade support wall 46, an inner blade support wall 48 and a front blade support wall 50. The outer blade support wall 46, inner blade support wall 48 and front blade support wall 50 are integrally formed together and arranged to form a U-shaped blade support channel 44. The front blade support wall 50 is arranged to set parallel and in contact with an upturned portion of the blade member 80. In at least some embodiments, a portion of the inner blade support wall 48 is integrally formed to the outer surface 14 of the handle tube member 10 and a portion of the outer blade support wall 46 is integrally formed to the outer surface 32 of the front wall 30. In this manner, loads on the up-turned portion of the shovel blade 80 are supported and distributed by the support structure 100. For further support and structure, each front blade support wall 50 includes at least one fastener aperture 52 for securing the upturned portion of the blade member 80 to each U-shaped blade support channel 44 with a fastener 94.

Still referring generally to FIGS. 1-17, in at least some embodiments, the inner surface 24 of the rear wall 20 includes a plurality of blade support ribs 54 integrally formed thereto. The blade support ribs 54 are shaped to extend between the inner surface 24 of the rear wall 20 and the rear surface 84 of the blade member 80 to provide structural support to the blade member 80. In some embodiments, a top surface 58 of each said blade support rib 54 is curved to support a curved rear surface 84 of the blade member 80. The inner surface 24 of rear wall 20 may also include a plurality of blade attachment tabs 56 secured adjacent the perimeter bottom wall 28. Each of the blade attachment tabs 56 are adapted to receive at least one fastener 94 for securing the blade member 80 to the support structure 100. It should be noted that the preferred material for constructing the support structure is resin material and, more particularly, the resin material is plastic of a type that is capable of injection or blow molding.

Referring to FIGS. 1-9, the blade member 80 is substantially flat as it extends transversely with respect to a longitudinal axis 78 of the handle tube member 10. In a most preferred embodiment, the blade member 80 includes an upturned portion 86 positionable adjacent the handle tube member 10, a cylindrical radius 88 extending between the flat portion 87 of the blade member 80 and the upturned portion 86 of the blade member.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A support structure for connecting a blade to a handle of a shovel comprising:

a handle tube member, said handle tube member having an inner tubular surface, an outer tubular surface, a top end surface and a bottom end surface, said inner tubular surface having a substantially conjugate shape with respect to a first end of a shovel handle for receiving said first end of said shovel handle therein, a rear wall, said rear wall including an outer surface, an inner surface, a rear wall perimeter surface and a perimeter bottom surface, said rear wall integrally formed to said outer tubular surface of said handle tube member along a rear portion thereof, said rear wall extending outward with respect to said handle tube member, a front wall spaced apart from and extending generally parallel with respect to said rear wall so that a space remains between said front wall and said rear wall, said front wall integrally formed to said handle tube member along a front portion thereof and extending outwardly with respect thereto, a top wall integrally formed to a perimeter surface of said rear wall and a perimeter surface of said front wall connecting said front wall and said rear wall along a top surface, as well as a left side perimeter surface and a right side perimeter surface of said rear wall, said top wall integrally formed to said handle tube member extending between said front wall and said rear wall, said front wall terminating short of the length of said rear wall, an intermediate wall integrally formed to and extending from a bottom perimeter surface of said front wall to said inner surface of said rear wall where the intermediate wall is also integrally formed, defining a box structure formed by said rear wall, said front wall, said top wall and said intermediate wall, said rear wall and said top wall extending beyond the length of said front wall to support a shovel blade, a perimeter bottom wall integrally formed to said top wall and said rear wall to provide a space between a rear surface of a blade member and said inner surface of said rear wall, a shovel blade member positioned and secured to be in contact with a front edge surface of said perimeter bottom wall and said left side perimeter top wall and said right side perimeter top wall to maintain said spacing between said rear surface of said blade member and said inner surface of said rear wall.

2. The support structure for connecting the blade to the handle of a shovel of claim 1 wherein said outer surface of said handle tube member is integrally formed to said intermediate wall.

3. The support structure for connecting the blade to the handle of a shovel of claim 1 wherein said bottom end surface of said handle tube member is integrally formed to said intermediate wall.

4. The support structure for connecting the blade to the handle of a shovel of claim 1 including at least one blade support channel, said at least one blade support channel integrally formed to and extending outwardly from an outer surface of said front wall, said blade support channel adapted to support an upturned portion of said blade member.

5. The support structure for connecting the blade to the handle of a shovel of claim 4 wherein said at least one blade support channel includes an outer blade support wall, an inner blade support wall and a front blade support wall, said outer blade support wall, said inner blade support wall and said front blade support wall integrally formed together and arranged to form a U-shaped blade support channel, said front blade support wall arranged to set parallel and in contact with said upturned portion of said blade member.

6. The support structure for connecting the blade to the handle of a shovel of claim 5 wherein a portion of said inner blade support wall is integrally formed to said outer surface of said handle tube member.

7. The support structure for connecting the blade to the handle of a shovel of claim 5 wherein a portion of said outer blade support wall is integrally formed to said outer surface of said front wall.

8. The support structure for connecting the blade to the handle of a shovel of claim 5 wherein said front blade support wall includes at least one fastener aperture for securing said upturned portion of said blade to said U-shaped blade support channel.

9. The support structure for connecting the blade to the handle of a shovel of claim 5 wherein said inner surface of said rear wall includes a plurality of blade support ribs integrally formed thereto, said blade support ribs shaped to extend between said inner surface of said rear wall and said rear surface of said blade member to provide structural support to said blade member.

10. The support structure for connecting the blade to the handle of a shovel of claim 9 wherein a top surface of each said blade support rib is curved to support a curved said rear surface of said blade member.

11. The support structure for connecting the blade to the handle of a shovel of claim 1 including at least one divider rib integrally formed to and extending between said rear wall and said front wall, providing structural support to said box structure.

12. The support structure for connecting the blade to the handle of a shovel of claim 11 wherein said divider rib is also integrally formed and extending between said top wall and said intermediate wall.

13. The support structure for connecting the blade to the handle of a shovel of claim 1 including a plurality of blade attachment tabs secured to said inner surface of rear wall adjacent said perimeter bottom wall, said blade attachment tabs each adapted to receive at least one fastener for securing said blade member to said support structure.

14. The support structure for connecting the blade to the handle of a shovel of claim 1 wherein said blade member is substantially flat and extends transversely with respect to a longitudinal axis of said handle tube member.

15. The support structure for connecting the blade to the handle of a shovel of claim 14 wherein said blade member includes an upturned portion positionable adjacent said handle tube member.

16. The support structure for connecting the blade to the handle of a shovel of claim 15 wherein said blade member includes a cylindrical radius extending between said flat portion of said blade member and said upturned portion of said blade member.

17. The support structure for connecting the blade to the handle of a shovel of claim 1 wherein said support structure is constructed from resin material.

18. The support structure for connecting the blade to the handle of a shovel of claim 17 wherein said resin material is plastic.

* * * * *